United States Patent [19]

Baziuk

[11] Patent Number: 4,838,439

[45] Date of Patent: Jun. 13, 1989

[54] HOIST FOR USE AT A MANHOLE

[76] Inventor: Morris Baziuk, Box 53, Group 6, R.R. #1, Winnipeg, Manitoba, Canada, R3V 1L2

[21] Appl. No.: 156,030

[22] Filed: Feb. 16, 1988

[30] Foreign Application Priority Data

Dec. 11, 1987 [GB] United Kingdom ..... 8728994

[51] Int. Cl.[4] ..... B66C 23/18

[52] U.S. Cl. ..... 212/254; 212/223; 212/229; 212/244; 212/253; 182/3

[58] Field of Search ..... 212/140, 151, 179, 180, 212/182, 223, 229, 244, 253, 254; 182/5, 3, 232, 233, 234, 142; 114/374

[56] References Cited

U.S. PATENT DOCUMENTS

| | | | |
|---|---|---|---|
| 81,317 | 8/1868 | Williams | 212/189 |
| 212,384 | 7/1921 | Manley . | |
| 935,413 | 9/1909 | Ryan | 114/374 |
| 1,517,562 | 12/1924 | Ljungman et al. | 212/229 |
| 1,887,965 | 11/1932 | Stoner | 212/140 |
| 1,978,999 | 10/1934 | Jones | 212/140 |
| 2,433,921 | 1/1948 | Nelson . | |
| 3,794,296 | 2/1974 | Hasstedt | 212/189 |
| 4,030,705 | 6/1977 | Bontrager . | |
| 4,050,587 | 9/1977 | Moen | 212/244 |
| 4,305,478 | 12/1981 | Geisinger | 182/3 |
| 4,660,679 | 4/1987 | Ostrobrod | 182/5 |

FOREIGN PATENT DOCUMENTS

| | | |
|---|---|---|
| 145400 | 1/1913 | Canada . |
| 560894 | 7/1958 | Canada . |
| 198102 | 3/1920 | United Kingdom . |

OTHER PUBLICATIONS

"The Shop Dolly" in Pacific Electric Cranes, 3/25/69.

*Primary Examiner*—Sherman D. Basinger
*Assistant Examiner*—Thomas J. Brahan
*Attorney, Agent, or Firm*—Stanley G. Ade; Adrian D. Battison; Murray E. Thrift

[57] ABSTRACT

A hoist for use over a man hole includes a H shaped base part defining two side struts and a cross strut offset toward one end of the side struts. The base part has four legs arranged at the ends of the side struts, adjustable in height and terminating in a flat pad for engaging the ground. A vertical sleeve part extends upwardly from the cross strut for receiving a swivel arm which is a separate item and can be inserted into the sleeve part for swivelling movement about a vertical axis. A swivel arm includes a jib portion extending out over the larger area defined forwardly of the cross-strut. Swivelling movement is limited to the forward area.

1 Claim, 2 Drawing Sheets

HOIST FOR USE AT A MANHOLE

BACKGROUND OF THE INVENTION

This invention relates to a hoist for use at a manhole of the type which can be used for raising and lowering the person entering the hole.

Recent safety legislation has mandated that it is necessary for persons entering manholes to be attached to a suitable hoist so that they can be recovered in the event of any difficulties being encountered, for example poisonous fumes which can accumulate in underground locations of this type.

A tripod hoist is available which includes three legs which stand at angularly spaced locations around the hole and converge to a central apex from which a cable descends into the manhole. This device however is generally unsatisfactory for a number of reasons, including the high initial cost, the unsatisfactory balancing condition and the obstruction of the manhole by the equipment which can interfere with the person or other equipment being passed through the hole. It is one object of the present invention, therefore, to provide an improved hoist of this general type. In addition various hoist type equipment is available for use in various different circumstances. Thus devices are proposed for use with lifting patients from a wheelchair and in lifting engines from an engine compartment of an automobile. However none of these devices is suitable for use at a manhole and it has been necessary for the present inventor to design a device which is specifically suited and adapted for the particular purpose of use as a hoist at a manhole.

SUMMARY OF THE INVENTION

According to a first definition of the invention, therefore, there is provided a hoist for use with a manhole comprising a substantially planar horizontal base member having a pair of side struts arranged in spaced generally parallel relationship, each side strut having a pair of ground engaging legs thereon spaced along the length of the side strut and extending downwardly therefrom and mounted thereon for vertical adjustment, the legs being arranged generally at the four corners of a rectangle, a cross member interconnecting the side struts at a position offset to one side of a centre line of the rectangle, a receiving member upstanding vertically from the cross member, a swivel arm releasably mounted on said receiving member for pivotal movement about a vertical axis, the arm having a vertical post portion and a jib portion extending outwardly to one side of the post portion, a cable winch mounted on the swivel arm and a pulley at an end of the jib portion remote from the post portion over which the cable passes to extend downwardly from the end of the jib portion through the base member and into the manhole.

Preferably the base member is generally H shaped consisting simply of the side struts and the cross member which is offset from the centre line of the rectangle but is positioned forwardly of the adjacent legs so that in use with the legs sitting at the angularly spaced positions around the manhole, the cross member is offset from the central axis of the manhole but overlies a portion of the manhole adjacent the side thereof. The simple H shaped base member allows full clearance between the side members and the cross member to allow equipment and the person to pass through the large area on the side of the cross member and between the side members into the hole.

Preferably the swivel arm comprises simply a fixed angle between the upwardly extending post portion and the jib portion which is inclined thereto at an angle of the order of 60° so as to extend upwardly and outwardly therefrom to a height sufficient to hold the winched man fully out of the hole. It will of course be appreciated that the man will be wearing a conventional harness which will be attached to the cable so that when the cable is fully winched in the man is held supported from the end of the jib portion at a position which he can be removed from the cable to one side of the manhole even if he is incapacitated by an accident of a like. The swivel arm is preferably formed of simple pipe construction with a supporting brace at the angle between the post portion and a jib portion.

Preferably the receiving portion at the cross member is formed as a short length of pipe into which the post portion can be inserted for simple swivelling movement about the axis of the pipe. This swivelling movement can be restricted to 180° in which the jib portion can rotate to either side to lie parallel to the cross member and between those extremes extends outwardly over the major portion of the manhole.

According to a second definition of the invention a hoist for use with a manhole comprising a substantially planar horizontal base member having a pair of side struts arranged in spaced generally parallel relationship, each side strut having a pair of ground engaging legs thereon spaced along the length the side strut and extending downwardly therefrom, and means mounting each leg on the respective side strut for manually actuable vertical adjustment, the legs being arranged generally at the four corners of a rectangle, each leg having on a lower end thereof a horizontal ground engaging pad, the side struts being interconnected by a single cross-member arranged at a position offset to one side of a centre line of the rectangle to define an area forwardly of said cross-member which can overlie the manhole, a receiving member upstanding vertically from the cross member, a swivel arm including means for mounting on said receiving member for pivotal movement about a vertical axis defined by said receiving member, the arm having a vertical post portion and a jib portion rigidly connected to the post portion, said swivel arm mounting means allowing ready release by a simple vertical movement of said swivel arm from said receiving member, means for restricting said pivotal movement of said swivel arm to an arc forwardly of said cross-member a cable winch mounted on the swivel arm and a pulley at an end of the jib portion remote from the post portion over which the cable passes to extend downwardly from the end of the jib portion through the base member and into the manhole.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

Figure 1:
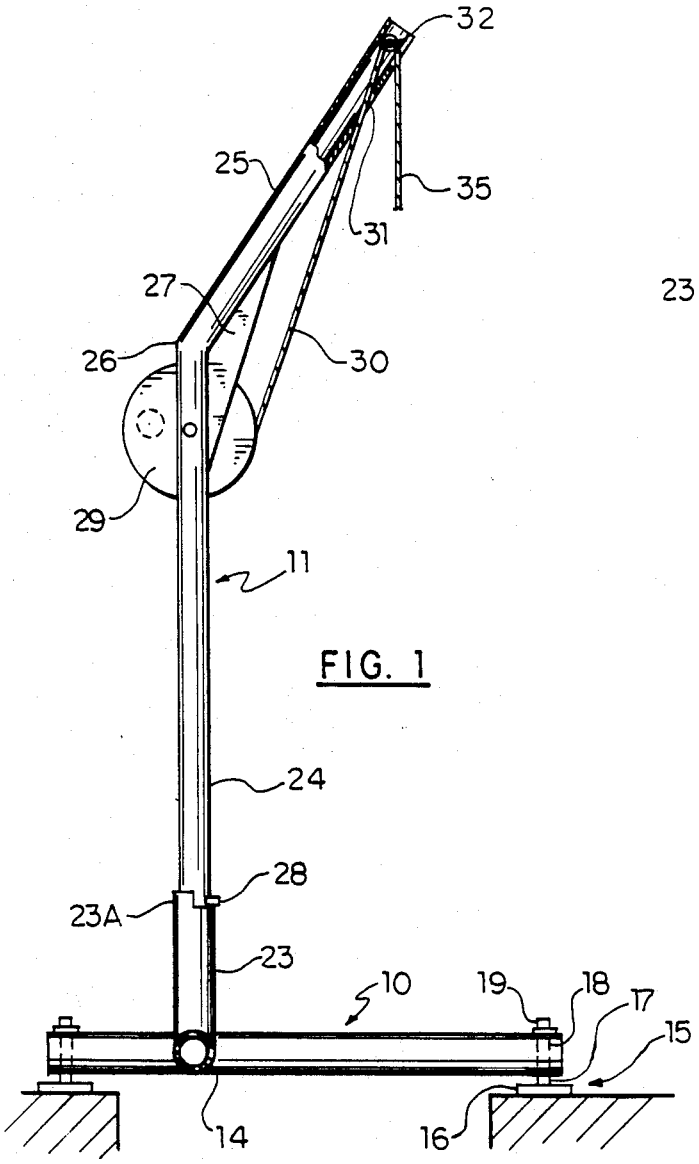
FIG. 1 is a side elevational view of the hoist according to the invention.

The basic invention comprises a base member 10 and a swivel arm 11 which are formed as two separate pieces which can be disconnected and carried separately for ease of transportion of the hoist device.

The base member 10 comprises a pair of side struts 12 and 13 and a cross member 14 which interconnects the side struts in the form of a H shape. Each of the side struts has at each end thereof a respective one of four legs 15 of a type comprising a flat pad 16 which can sit on the ground and a screw shaft 17 joining the pad to the side strut. The screw 17 passes through a female screw thread 18 in the side struts with a suitable cranking mechanism indicated at a head 19 on the top of the screw 17 to allow vertical adjustment of the height of the pad 16 relative to the end of the respective side strut.

Thus the four legs 15 are arranged at the corners of a rectangle. The side struts 12 and 13 do not extend straight along the side of the rectangle but are cranked slightly inwardly at the junction with the cross member 14 so as to reduce the unsupported length of the cross member 14. The cross member 14 is offset from a centre line of the rectangle thus defining a larger area 20 on one side of the cross member than on the other side as indicated at 21 to define a working area between the side struts 12 and 13 and forwardly of the cross member 14 which is sufficient in size to receive equipment to be passed through the hole and also the person who can simply pass between the three parts defining the area 20.

Figure 3:
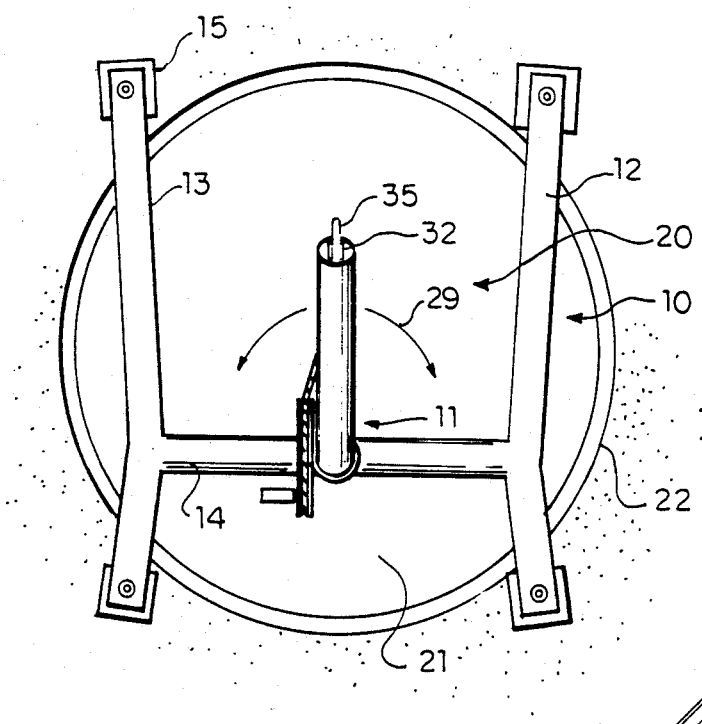
FIG. 3 is a top plan view of the hoist of FIG. 1.
Figure 4:
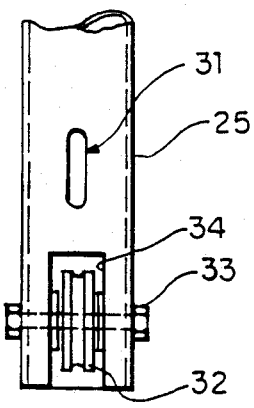
FIG. 4 is an elevational view on an enlarged scale of the end of the jib portion showing the pulley.

The offset of the cross member 14 is not, however, sufficient to take the cross member beyond the edge of the manhole so that any weight applied to the swivel arm 11 is applied forwardly of the rearward most legs as shown in FIG. 3 to maintain the device properly in balance over the hole which is indicated at 22.

Welded to an upper surface of the cross member 14 is a pipe 23 which extends vertically upwardly to define a vertical swivel axis for the swivel arm 11.

The swivel arm 11 comprises a vertical post portion 24 and a jib portion 25 which is rigidly connected to the post portion and extends upwardly and outwardly therefrom at an angle of the order of 60° to the horizontal. Both the post portion 24 and the jib portion 25 are formed from pipe welded at the elbow indicated at 26 and supported by a cross brace 27 in the form of a web along the inside of the angle.

Figure 2:
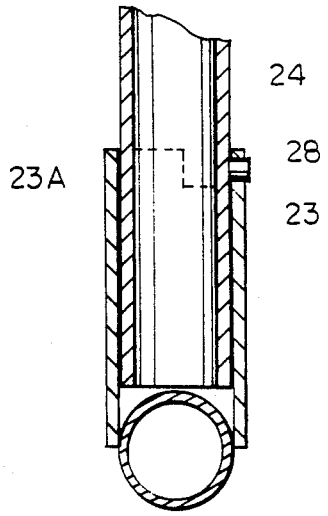
FIG. 2 is a cross sectional view on an enlarged scale of a portion of the base member and receiving member.

Turning to the enlarged view shown in FIG. 2, it will be noted that the inside diameter of the upstanding receiving pipe 23 is slightly greater than the outside diameter of the pipe forming the proposed portion 24 so that the latter is a sliding fit inside the receiving portion and is maintained in the required upright position but is rotatable about a vertical axis defined by the pipe 23. The outside upper end of the pipe 23 is cut down over 180° of its periphery to form a step 23A at the rear of the portion which cooperates with a lug 28 welded to the front of the post portion 24 to restrict rotation of the post portion to an angle of the order of 180°. The swivel arm can thus rotate as indicated at the arrow 29 through 180° from the position spacing sidewardly parallel to the cross member 14 on either side of the receiving pipe 23 that is to a retracted position allowing full access to the area 20 and in between those positions it lies in the operative position overlying the manhole 22. A winch 29 of conventional construction is mounted on the post portion 24 for paying out and recovering a cable 30 which extends through an opening 31 in the underside of the pipe forming the jib portion 25 to a pulley 32 inside the end of the jib portion. The pulley is suitably mounted on a cross bolt 33 and is exposed at a slot 34 so that the cable 30 can extend downwardly as indicated at 35 for attachment to the harness of the operative.

Figure 5:
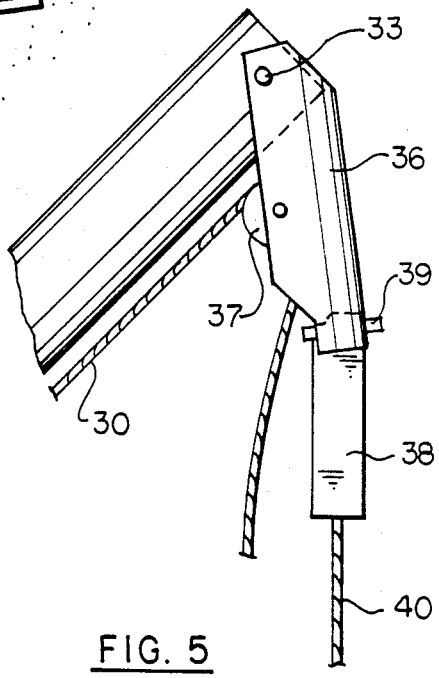
FIG. 5 is a side elevational view of the end of the jib portion showing an additional attachment in place of the simple pulley of FIG. 4.

In the arrangement shown in FIG. 5, the pulley 32 is removed and an adaption device 36 attached onto the pin 33 in its place. The adaption device 36 carries additional pulley 37 which can be used in place of the pulley 32 together with a payout device 38 which is attached to the device 36 by a pin 39. The payout device is commercially available and is of a type which pays out a cable 40 under tension and has an automatic spring return biasing the cable 40 back into its retracted position. The device 38 also acts to lock the cable 40 when its speed of withdrawal exceeds a predetermined maximum for example when the operative falls. Thus the operative can be attached both to the cable 40 and to the cable 30.

The two parts of the device comprising the base member and the swivel arm are both formed from aluminum material to provide sufficient strength at lightweight so the device is readily removable and transportable.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A hoist for use with a manhole comprising a substantially planar horizontal base member and a swivel arm member, the base member consisting of a pair of tubular side struts, each side strut having ground engaging means thereon consisting solely of a pair of vertical ground engaging legs arranged at respective ends of the side strut extending downwardly therefrom and mounted thereon for vertical adjustment, each leg having a flat horizontal plate on its lower end, a cross member interconnecting the side struts at a position offset to one side of a center line of the side struts such that a shorter portion of each side strut extends rearwardly of the cross member and a longer portion of each side strut extends forwardly therefrom, the side struts and the cross member lying in a common horizontal plane, each side strut being cranked at the cross member so as to extend forwardly and outwardly therefrom, and a vertically upstanding sleeve welded on the cross member; the swivel arm member consisting solely of a vertical tubular post portion having an outside diameter such that it can be releasably mounted in said sleeve for pivotal movement about a vertical axis, a tubular jib portion welded to the post portion at a fixed acute angle thereto less than 90° so as to extend upwardly and outwardly to one sie of the post portion such that an outer end of the jib portion is a fixed distance from the sleeve, a hand-operated cable winch mounted on the post portion and a pulley contained within the end of the jib portion remote from the post portion over which a cable from the winch passes to extend downwardly from the end of the jib portion through the base member and into the manhole, the sleeve having an upper edge which has a rebated portion over an arc of the order of 180° and the post portion having a lug projecting radially from an outer surface thereof which cooperates with the rebated portion to restrict the pivotal movement of the post portion to an arc substantially lying forwardly of the cross member.

* * * * *